US010155141B2

(12) United States Patent
Yoshida

(10) Patent No.: US 10,155,141 B2
(45) Date of Patent: Dec. 18, 2018

(54) GOLF CLUB HEAD

(71) Applicant: BRIDGESTONE SPORTS CO., LTD., Tokyo (JP)

(72) Inventor: Shintaro Yoshida, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 15/810,635

(22) Filed: Nov. 13, 2017

(65) Prior Publication Data

US 2018/0161644 A1 Jun. 14, 2018

(30) Foreign Application Priority Data

Dec. 8, 2016 (JP) ..... 2016-238658

(51) Int. Cl.
*A63B 53/08* (2015.01)
*A63B 53/04* (2015.01)

(52) U.S. Cl.
CPC ..... *A63B 53/0466* (2013.01); *A63B 53/04* (2013.01); *A63B 53/08* (2013.01); *A63B 2053/045* (2013.01); *A63B 2053/0437* (2013.01)

(58) Field of Classification Search
CPC ..... A63B 2053/0437; A63B 2053/045; A63B 53/08; A63B 53/0466
USPC ..... 473/345, 346
See application file for complete search history.

(56) References Cited

U.S. PATENT DOCUMENTS 5,511,786 A * 4/1996 Antonious ..... A63B 53/04 473/327
9,839,819 B2 * 12/2017 Mizutani ..... A63B 60/52
9,914,025 B2 * 3/2018 Larson ..... A63B 53/0466
2003/0104878 A1 * 6/2003 Yabu ..... A63B 53/04 473/345
2003/0114244 A1 * 6/2003 Matsunaga ..... A63B 53/0466 473/345
2011/0294599 A1 12/2011 Albertsen et al.
2012/0135821 A1 * 5/2012 Boyd ..... A63B 53/0466 473/342
2012/0142452 A1 * 6/2012 Burnett ..... A63B 53/0466 473/345
2013/0344987 A1 * 12/2013 Takechi ..... A63B 53/0466 473/345
2014/0080626 A1 3/2014 Bezilla et al.
2016/0151686 A1 6/2016 Larson et al.
2016/0158609 A1 6/2016 Takagi et al.
2017/0333767 A1 * 11/2017 Cole ..... A63B 53/0466

FOREIGN PATENT DOCUMENTS

JP 2003-088601 3/2003
JP 2005-073736 3/2005
JP 2013-544179 12/2013
JP 2014-121602 7/2014
JP 2015-213786 12/2015
JP 2016-106885 6/2016

* cited by examiner

*Primary Examiner* — Benjamin Layno
(74) *Attorney, Agent, or Firm* — IPUSA, PLLC

(57) ABSTRACT

A hollow golf club head includes a face defining a front of the golf club head, a sole, and a crown. The crown includes a front depression formed in the outside surface of the crown and a rear depression formed in the inside surface of the crown. The front depression is closer to the face than is the rear depression in a front-rear direction from the front to a rear of the golf club head.

6 Claims, 6 Drawing Sheets

GOLF CLUB HEAD

CROSS-REFERENCE TO RELATED APPLICATION

This application is based upon and claims priority to Japanese Patent Application No. 2016-238658, filed on Dec. 8, 2016, the entire contents of which are incorporated herein by reference.

BACKGROUND OF THE INVENTION

1. Field of the Invention

The present invention relates to golf club heads.

2. Description of the Related Art

With respect to golf club heads, various techniques have been studied to increase the launch angle of a golf ball to improve the ball striking performance. Such techniques for improving the ball striking performance include, for example, those described in Japanese Laid-open Patent Publication Nos. 2015-213786, 2014-121602, 2005-073736, 2003-088601 and 2016-106885, Japanese National Publication of International Patent Application No. 2013-544179, and U.S. Patent Application Publication No. 2016/0151686. It is desired to give sufficient consideration to the crown-side flexibility to increase the launch angle of a golf ball to improve the ball striking performance.

SUMMARY OF THE INVENTION

According to an aspect of the present invention, a hollow golf club head includes a face defining a front of the golf club head, a sole, and a crown. The crown includes a front depression formed in the outside surface of the crown and a rear depression formed in the inside surface of the crown. The front depression is closer to the face than is the rear depression in a front-rear direction from the front to a rear of the golf club head.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE PREFERRED EMBODIMENTS

Figure 1:
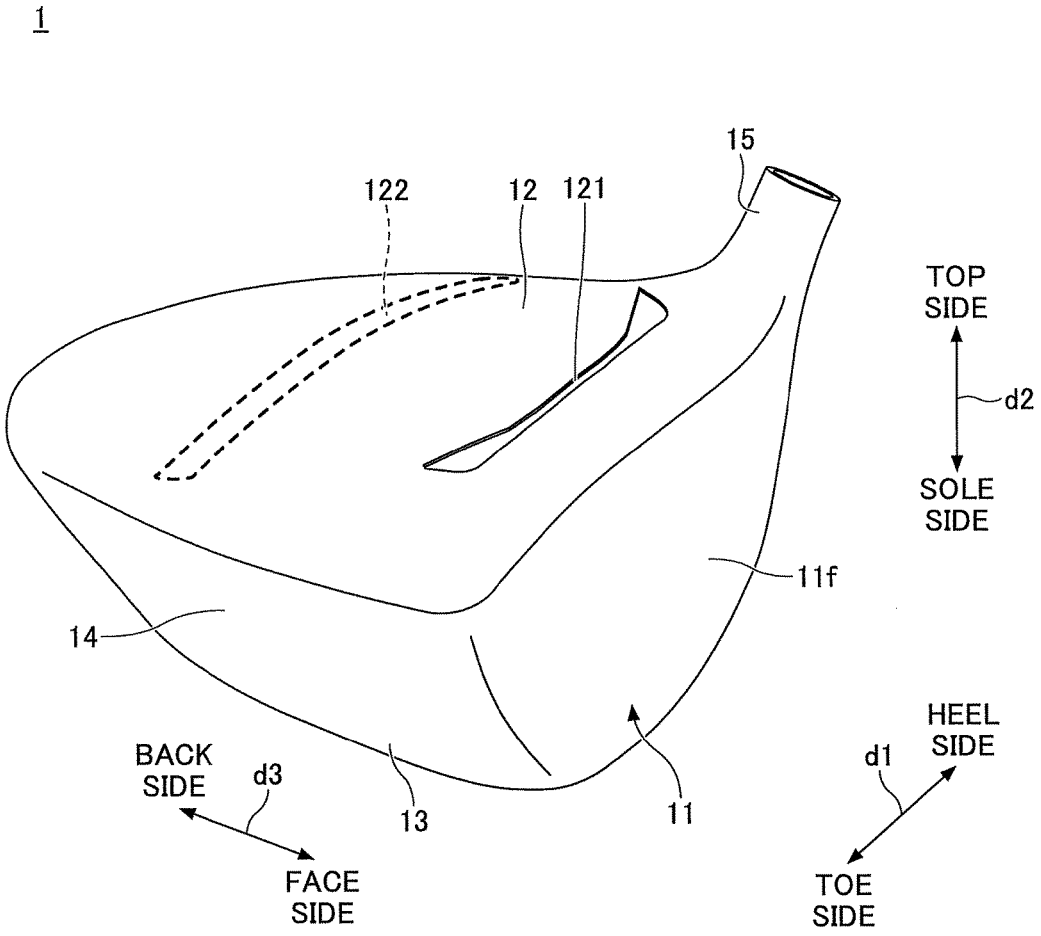
FIG. 1 is a perspective view of a golf club head according to an embodiment.

One or more embodiments are described below with reference to the accompanying drawings. In the following description, the same elements are referred to using the same reference numeral, and duplicate description thereof may be omitted.

Figure 2:
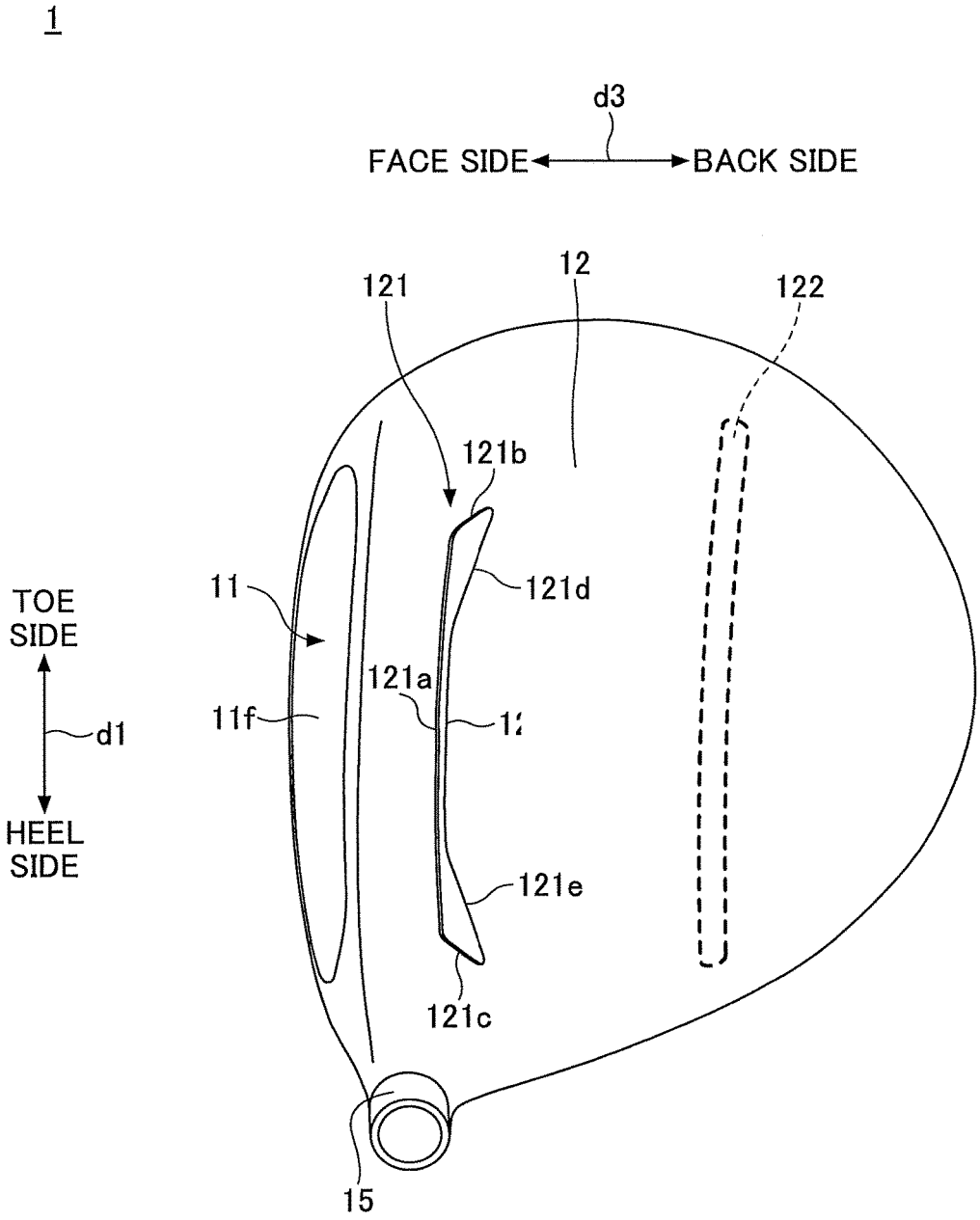
FIG. 2 is a plan view of the golf club head according to the embodiment.
Figure 3:
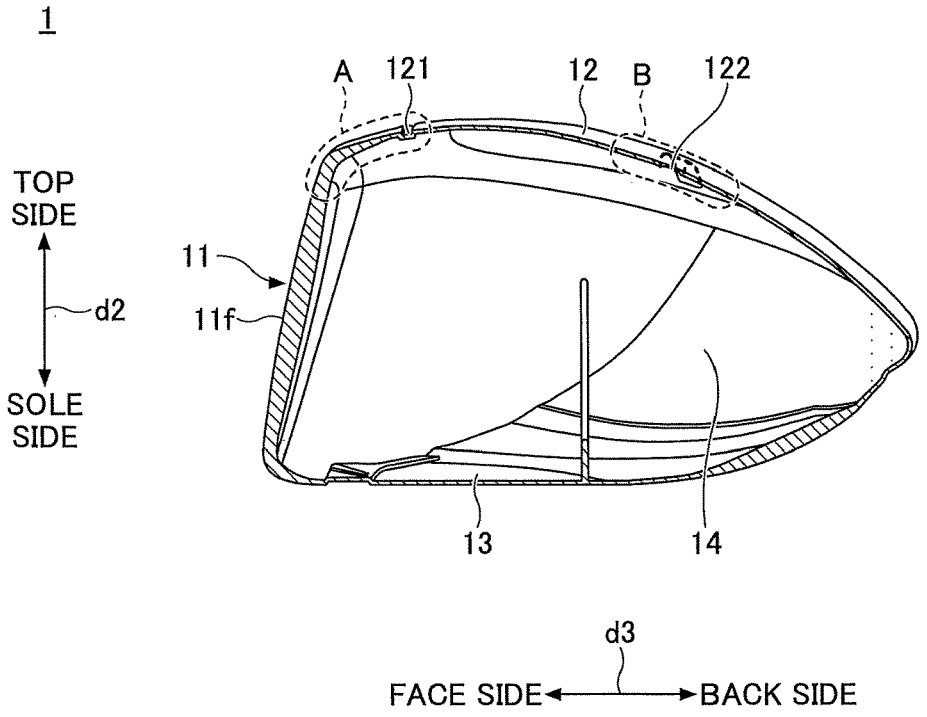
FIG. 3 is a cross-sectional view of the golf club head according to the embodiment.

FIGS. 1 and 2 are a perspective view and a plan view, respectively, of a golf club head 1 according to an embodiment. FIG. 3 is a cross-sectional view of the golf club head 1, depicting a vertical cross section along a face-back direction, passing through the substantial center of the face of the golf club head 1.

FIGS. 1 through 3 illustrate the case where the golf club head 1 rests on a horizontal plane (corresponding to a ground surface) at a reference lie angle and a reference loft angle. In the drawings, the double-headed arrow d1 indicates the "toe-heel" (left-right) direction, namely, the direction from the toe or the toe side to the heel or the heel side or the direction from the heel or the heel side to the toe or the toe side, of the golf club head 1, the double-headed arrow d2 indicates the "top-sole" (top-bottom) direction, namely, the direction from the top or the top side to the sole or the sole side or the direction from the sole or the sole side to the top or the top side, of the golf club head 1, and the double-headed arrow d3 indicates the "face-back" (front-rear) direction, namely, the direction from the face or the face side to the back (rear) or the back side or the direction from the back or the back side to the face or the face side, of the golf club head 1.

The golf club head 1 depicted in FIGS. 1 through 3 is a wood-type golf club head such as a driver club head, but may also be a hybrid club head or a fairway wood club head. The golf club head 1 may be made using a metal material such as a titanium alloy, titanium, stainless steel, or an aluminum alloy. Multiple parts may be joined and assembled into the golf club head 1. The golf club head 1 is described in more detail below.

The golf club head 1 is a hollow structure that includes a face 11, a crown 12, a sole 13, a sidewall 14, and a hosel 15. In the following description, a surface corresponding to an inside surface of the hollow structure may be referred to as an inside surface, and a surface corresponding to an outside surface of the hollow structure may be referred to as an outside surface. Furthermore, the inside or internal space of the hollow structure may be referred to as "hollow."

The face 11 defines a front portion of the golf club head 1, and includes a face surface 11*f*, which defines a ball-striking surface between the crown 12 and the sole 13 in the top-sole direction. The face 11 has a predetermined thickness. The face surface 11*f* forms an outside surface of the face 11. The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 11*f*. The hosel 15 receives a shaft.

Figure 4:
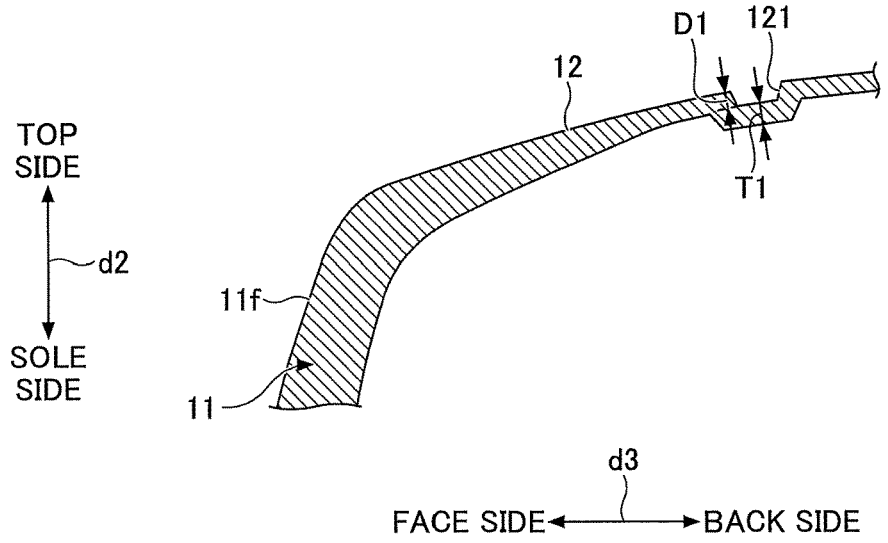
FIG. 4 is an enlarged view of part A of the golf club head of FIG. 3, depicting a vertical cross section of the part A.
Figure 5:
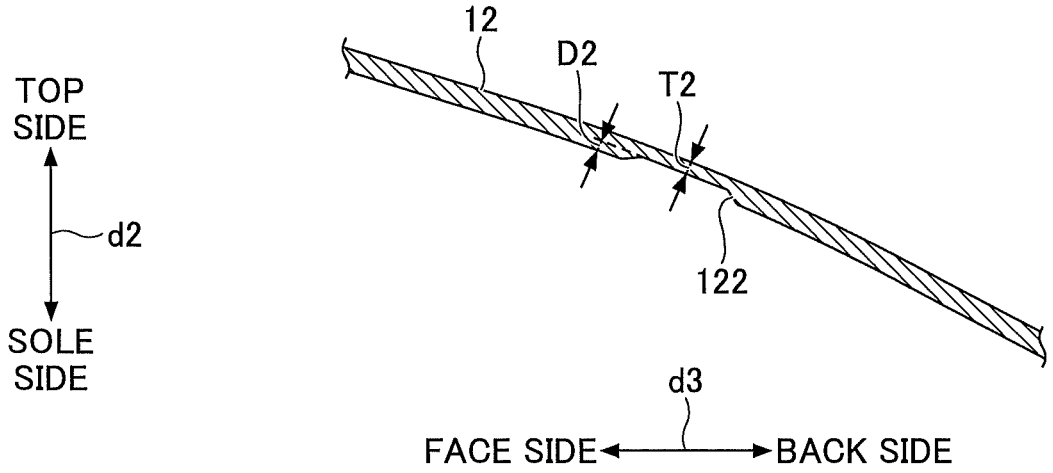
FIG. 5 is an enlarged view of part B of the golf club head of FIG. 3, depicting a vertical cross section of the part B.

FIG. 4 is an enlarged view of part of the golf club head 1, depicting a vertical cross section of part of the face 11 and part of the crown 12 indicated by the dashed line A in FIG. 3. FIG. 5 is an enlarged view of part of the golf club head 1, depicting a vertical cross section of part of the crown 12 indicated by the dashed line B in FIG. 3. Referring to FIGS. 1 through 5, a front depression 121 elongated in the toe-heel direction is provided in the crown 12 on the face 11 side. A rear depression 122 elongated in the toe-heel direction is provided in the crown 12 on the back side.

The crown 12 includes a first depressed portion where the outside surface of the crown 12 is depressed inward (toward the hollow) to form the front depression 121. The crown 12 includes a second depressed portion where the inside surface of the crown 12 is depressed outward (toward the outside surface of the golf club head 1) to form the rear depression 122.

Furthermore, the inside surface of the crown 12 protrudes inward (toward the hollow) in the first depressed portion where the front depression 121 is formed, more specifically, in part of the crown 12 at the bottom of the front depression 121, while the outside surface of the crown 12 does not protrude outward (toward the outside of the golf club head 1) in the second depressed portion where the rear depression 122 is formed, more specifically, in part of the crown 12 at the bottom of the rear depression 122. That is, the outside surface of the crown 12 is free of protrusions or steps in the second depressed portion. Accordingly, the rear depression 122 is not externally visible or perceivable (from outside the golf club head 1).

Furthermore, referring to FIGS. 4 and 5, a wall thickness T1 of the crown 12 at the bottom of the front depression 121 is greater than a wall thickness T2 of the crown 12 at the bottom of the rear depression 122. The wall thickness T1 may be, for example, 0.3 mm or more and 1.0 mm or less (0.3 mm≤T1≤1.0 mm). The wall thickness T2 may be, for example, 0.1 mm or more and 0.8 mm or less (0.1 mm≤T2≤0.8 mm). By increasing the wall thickness T1, the golf club head 1 can be more durable on the face 11 side. By decreasing the wall thickness T2, the crown 12 can be more flexible.

A depth D1 of the front depression 121 may be, for example, 0.3 mm or more and 1.0 mm or less (0.3 mm≤D1≤1.0 mm). A depth D2 of the rear depression 122 may be, for example, 0.1 mm or more and 0.5 mm or less (0.1 mm≤D2≤0.5 mm).

Figure 6:
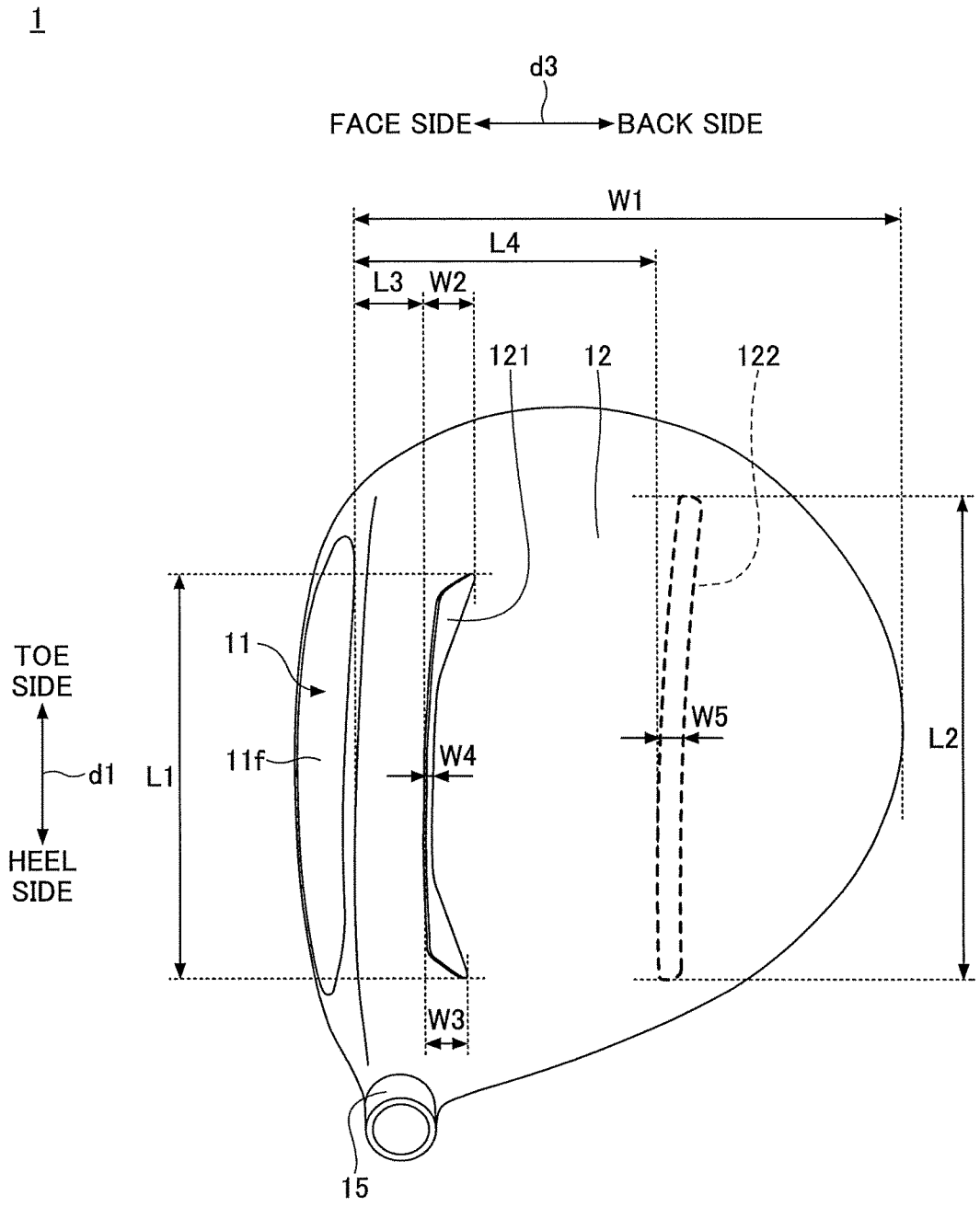
FIG. 6 is a diagram for illustrating the position and the size (dimensions) of each of a front depression and a rear depression.

FIG. 6 is a diagram for illustrating the position and the size (dimensions) of each of the front depression 121 and the rear depression 122. Referring to FIG. 6, a length L2 of the rear depression 122 in the toe-heel direction is greater than a length L1 of the front depression 121 in the toe-heel direction.

The front depression 121 is close to the face 11 that strikes a golf ball. Therefore, to improve the face-side durability of the golf club head 1, it is preferable to limit the toe-heel length L1 of the front depression 121. In contrast, the rear depression 122 is distant from the face 11, and where the rear depression 122 is formed, the golf club head 1 is not required to be as durable as on the face 11 side. Therefore, the toe-heel length L2 of the rear depression 122 may be large. By increasing the toe-heel length L2 of the rear depression 122, the golf club head 1 can be more flexible on the crown 12 side when striking a golf ball.

The toe-heel length L1 of the front depression 121 may be, for example, 30 mm or more and 110 mm or less (30 mm≤L1≤110 mm). The toe-heel length L2 of the rear depression 122 may be, for example, 40 mm or more and 120 mm or less (40 mm≤L2≤120 mm).

Furthermore, in a plan view, letting a width W1, namely, a distance between the front end and the rear end of the crown 12 in the face-back direction, be 100%, a distance L3 between the frontmost (foremost) end of the front depression 121 and the front end of the crown 12 is preferably 5% or more and 30% or less (5%≤L3≤30%), and a distance L4 between the frontmost (foremost) end of the rear depression 122 and the front end of the crown 12 is preferably 40% or more and 70% or less (40%≤L4≤70%). The front end of the crown 12 is the position of the boundary between the face 11 and the crown 12.

Here, a plan view refers to a view taken from a direction normal to a horizontal plane (corresponding to a ground surface) on which the golf club head 1 rests at a reference lie angle and a reference loft angle.

Furthermore, a width W2, namely, a distance between the frontmost end of the front depression 121 and the toe-side rearmost end of the front depression 121 in the face-back direction, may be, for example, 3 mm or more and 15 mm or less (3 mm≤W2≤15 mm). In addition, a width W3, namely, a distance between the frontmost end of the front depression 121 and the heel-side rearmost end of the front depression 121 in the face-back direction, may be, for example, 3 mm or more and 15 mm or less (3 mm≤W3≤15 mm). A width W4, namely, a width of the narrowest part of the front depression 121, may be, for example, 1 mm or more and 5 mm or less (1 mm≤W4≤5 mm). The width W2 and the width W3 may be equal.

Repulsion at the time of striking a golf ball with the golf club head 1 is lower on the toe side and the heel side of the face 11 than at the center of the face 11. By causing the width W2 and the width W3 to be greater than the width W4, the flexure of the golf club head 1 on the crown 12 side can be greater at the time of striking a golf ball on the toe side or the heel side of the face 11 than at the time of striking a golf ball at the center of the face 11.

As a result, a difference in striking performance between the case of striking a golf ball at the center of the face 11 and the case of striking a golf ball on the toe side or the heel side of the face 11 can be reduced.

A width W5 of the rear depression 122, which is substantially constant by way of example, may be, for example, 1 mm or more and 15 mm or less (1 mm≤W5≤15 mm). Instead of being substantially constant, the width W5 may differ depending on the position along the length of the rear depression 122 on an as-needed basis.

Figure 7:
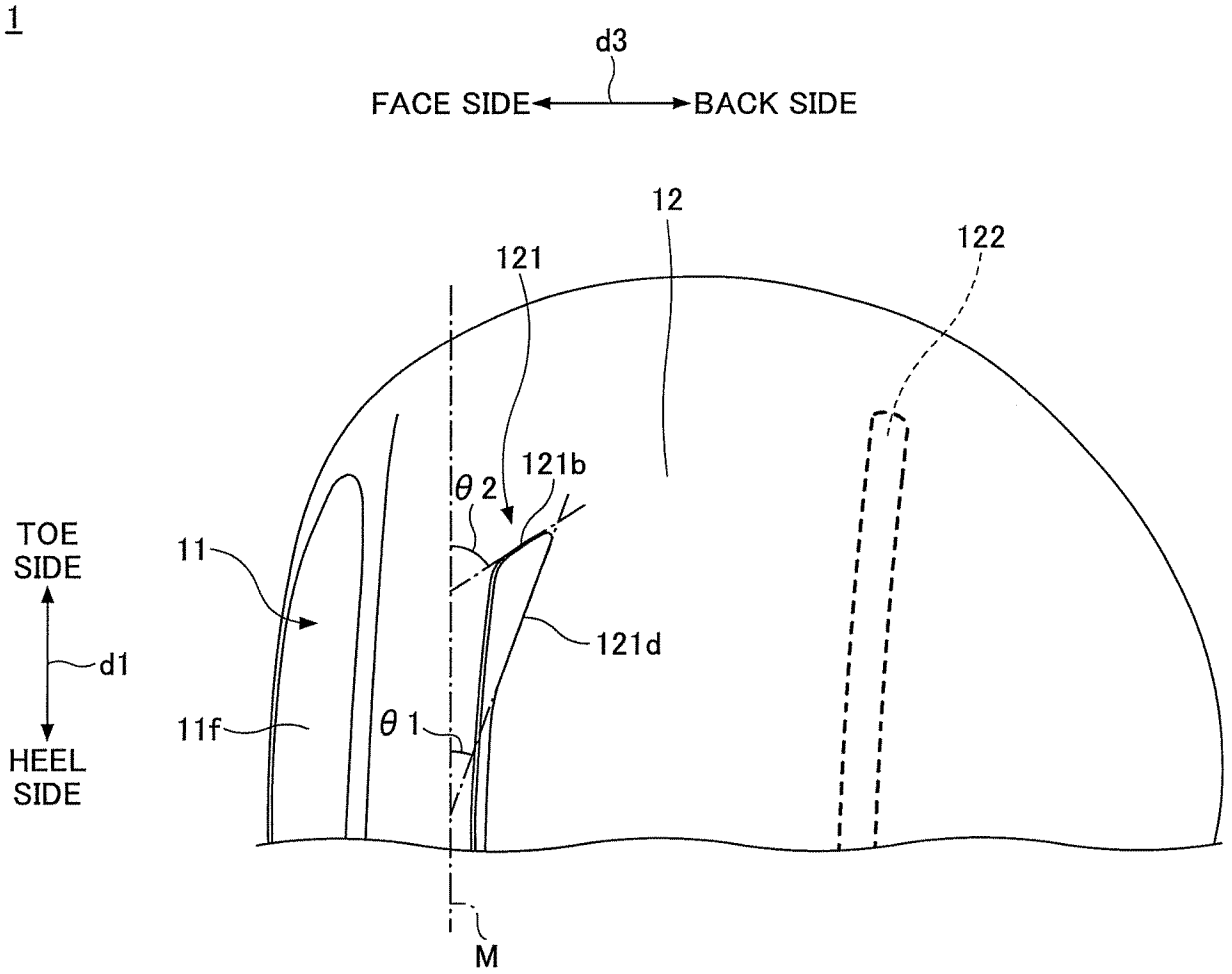
FIG. 7 is an enlarged plan view of a toe-side part of the golf club head of FIG. 2.

FIG. 7 is an enlarged plan view of a toe-side part of the golf club head 1 of FIG. 2. In FIG. 7, the one-dot chain line M indicates a straight line parallel to the toe-heel direction.

Referring to FIGS. 2 and 7, the front depression 121 includes a front end 121*a*, a toe-side side end 121*b*, a heel-side side end 121*c*, a toe-side rear end 121*d*, a heel-side rear end 121*e*, and a center rear end 121*f*.

The toe-side side end 121*b* is inclined to be closer to the toe of the golf club head 1 as coming closer to the back of the golf club head 1. The heel-side side end 121*c* is inclined to be closer to the heel of the golf club head 1 as coming closer to the back of the golf club head 1.

The toe-side rear end 121*d* is inclined to be closer to the toe of the golf club head 1 as coming closer to the back of the golf club head 1. Furthermore, an angle θ1, namely, the angle of inclination of the toe-side rear end 121*d* relative to the toe-heel direction, is smaller than an angle θ2, namely, the angle of inclination of the toe-side side end 121*b* relative to the toe-heel direction. This shape gradually increases the width of the front depression 121 from the center toward the toe side to make it possible to cause the width of the front depression to gradually become more effective from the center toward the toe side.

Likewise, the heel-side rear end 121*e* is inclined to be closer to the heel of the golf club head 1 as coming closer to the back of the golf club head 1. Furthermore, the angle of inclination of the heel-side rear end 121*e* relative to the toe-heel direction is smaller than the angle of inclination of the heel-side side end 121*c* relative to the toe-heel direction. This shape gradually increases the width of the front depression 121 from the center toward the heel side to make it possible to cause the width of the front depression to gradually become more effective from the center toward the heel side.

When the golf club head strikes a golf ball, the crown tends to deform to protrude upward on the face 11 side and protrude downward on the back side. Therefore, according to the golf club head 1, the front depression 121, formed in the outside surface of the crown 12 toward the hollow, is provided in the crown 12 on the face 11 side to allow easier deformation of the crown 12 on the face 11 side, and the rear depression 122, formed in the inside surface of the crown 12 toward the outside of the golf club head 1, is provided in the crown 12 on the back side to allow easier deformation of the crown 12 on the back side.

This allows the golf club head 1 to easily flex on the crown 12 side when striking a golf ball to increase the launch angle of the golf ball to improve the ball striking performance of the golf club head 1.

Thus, according to an aspect of the present invention, a golf club head with improved flexibility on the crown 12 side is provided.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, the hosel 15 may be configured to allow a sleeve fixed to the end of a shaft to be removably attached to the hosel 15. Use of the sleeve facilitates replacement of the shaft. Furthermore, the axis of a shaft insertion hole provided in the sleeve may be inclined relative to the central axis of the bore of the hosel 15. In this case, it is possible to change the lie angle or face angle by rotating the sleeve about its axis to change a position at which the sleeve fits to the hosel 15.

What is claimed is:

1. A hollow golf club head comprising:

a face defining a front of the golf club head;

a sole; and a crown including a front depression formed in an outside surface of the crown and a rear depression formed in an inside surface of the crown, the front depression being closer to the face than is the rear depression in a front-rear direction from the front to a rear of the golf club head, wherein the rear depression is longer than the front depression in a direction from a toe to a heel of the golf club head.

2. The golf club head as claimed in claim 1, wherein the inside surface of the crown protrudes inward where the front depression is formed, and the outside surface of the crown does not protrude outward where the rear depression is formed.

3. A hollow golf club head comprising:

a face defining a front of the golf club head;

a sole; and a crown including a front depression formed in an outside surface of the crown and a rear depression formed in an inside surface of the crown, the front depression being closer to the face than is the rear depression in a front-rear direction from the front to a rear of the golf club head, wherein, in a plan view of the golf club head, a distance between a frontmost end of the front depression and a front end of the crown is 5% or more and 30% or less of a width of the crown, and a distance between a frontmost end of the rear depression and the front end of the crown is 40% or more and 70% or less of the width of the crown, the width of the crown being a distance between the front end and a rear end of the crown in the front-rear direction.

4. The golf club head as claimed in claim 3, wherein the inside surface of the crown protrudes inward where the front depression is formed, and the outside surface of the crown does not protrude outward where the rear depression is formed.

5. A hollow golf club head comprising:

a face defining a front of the golf club head;

a sole; and a crown including a front depression formed in an outside surface of the crown and a rear depression formed in an inside surface of the crown, the front depression being closer to the face than is the rear depression in a front-rear direction from the front to a rear of the golf club head, wherein a thickness of the crown is greater at a bottom of the front depression than at a bottom of the rear depression.

6. The golf club head as claimed in claim 5, wherein the inside surface of the crown protrudes inward where the front depression is formed, and the outside surface of the crown does not protrude outward where the rear depression is formed.

* * * * *